US008324983B2

(12) United States Patent
Brandau

(10) Patent No.: US 8,324,983 B2
(45) Date of Patent: Dec. 4, 2012

(54) SELECTABLE COUPLING LEVEL WAVEGUIDE COUPLER

(75) Inventor: Ronald J. Brandau, Lockport, IL (US)

(73) Assignee: Andrew LLC, Hickory, NC (US)

( * ) Notice: Subject to any disclaimer, the term of this patent is extended or adjusted under 35 U.S.C. 154(b) by 172 days.

(21) Appl. No.: 12/901,760

(22) Filed: Oct. 11, 2010

(65) Prior Publication Data

US 2012/0086518 A1 Apr. 12, 2012

(51) Int. Cl.
*H01P 3/12* (2006.01)
*H01P 5/12* (2006.01)

(52) U.S. Cl. ..... 333/113; 333/122

(58) Field of Classification Search ..... 333/113, 333/117, 122, 135, 137, 157, 208, 209, 239, 333/248
See application file for complete search history.

(56) References Cited

U.S. PATENT DOCUMENTS

| | | | | |
|---|---|---|---|---|
| 2,558,385 | A | 6/1951 | Purcell | |
| 2,626,990 | A | 1/1953 | Pierce | |
| 3,044,026 | A | 5/1959 | Patterson | |
| 2,951,997 | A | 9/1960 | Stone | |
| 2,975,381 | A | 3/1961 | Reed et al. | |
| 3,758,879 | A | 9/1973 | Beguin et al. | |
| 4,146,817 | A | 3/1979 | McEuen et al. | |
| 4,567,401 | A | 1/1986 | Barnett et al. | |
| 4,635,006 | A | 1/1987 | Praba | |
| 4,679,011 | A | 7/1987 | Praba et al. | |
| 4,686,493 | A * | 8/1987 | Chang et al. | 333/113 |
| 4,792,770 | A | 12/1988 | Parekh et al. | |
| 4,812,788 | A * | 3/1989 | Wong et al. | 333/113 |
| 4,818,964 | A | 4/1989 | Wong | |
| 5,047,738 | A | 9/1991 | Wong et al. | |
| 5,247,268 | A | 9/1993 | Meise | |
| 6,127,902 | A | 10/2000 | Speldrich et al. | |
| 7,671,700 | B1 | 3/2010 | Rosenberg et al. | |
| 2002/0093384 | A1 | 7/2002 | Woods et al. | |
| 2006/0284700 | A1 | 12/2006 | Dabrowski et al. | |
| 2009/0289742 | A1 | 11/2009 | Oguma | |
| 2010/0238085 | A1 | 9/2010 | Fuh et al. | |

FOREIGN PATENT DOCUMENTS

| | | |
|---|---|---|
| DE | 1 192 713 | 5/1965 |
| FR | 1.115.719 | 4/1953 |
| JP | 3-53007 | 5/1991 |
| JP | 10-126118 | 5/1998 |

OTHER PUBLICATIONS

Byung IL AN, International Search Report for counterpart application PCT/US2011/050764, Feb. 27, 2012, Korean Intellectual Property Office, Seo-gu, Daejeon, Korea.

* cited by examiner

*Primary Examiner* — Dean O Takaoka
(74) *Attorney, Agent, or Firm* — Babcock IP, PLLC

(57) ABSTRACT

A waveguide coupler is provided with a trough portion with a first trough and a second trough. A coupling slot between the inner sidewalls of the first and second troughs communicates between the first trough and the second trough. A cover closes the first trough and the second trough to form first and second waveguides. The cover includes a protrusion surface with protrusions extending into the first trough and the second trough. The protrusions form a stepped ridge with a plurality of steps in height, if desired, lateral position. The steps are provided with a maximum inward extension and a minimum lateral distance from the coupling slot at a center step proximate a center of the coupling slot. The coupler is selectable between a high coupling level and a low coupling level by exchanging the cover applied to the trough portion between a flat surface and the protrusion surface.

18 Claims, 8 Drawing Sheets

SELECTABLE COUPLING LEVEL WAVEGUIDE COUPLER

BACKGROUND

A waveguide coupler may be used combine, sample and/or to detect simultaneous forward and reflected power levels of RF signals within a microwave communication system.

Prior waveguide couplers have applied coupling slot configurations between adjacent waveguides including several slots of precise width, dependent upon a desired operating frequency band of the communications system. Further, to operate in the H signal plane, features along the waveguide sidewalls may be added, also with a high degree of precision, to match the desired operating frequency band. The coupling level between the waveguides may be determined by the number/scale of the coupling slots and/or sidewall features.

The design of a waveguide coupler is typically highly frequency and coupling level specific, requiring a manufacturer to provide a range of different waveguide couplers, each with a specific operating frequency and coupling level, with minimal manufacturing efficiencies between the different designs, in order to satisfy market demands.

Prior waveguide couplers with adjustable coupling levels have utilized complex motorized insertion/retraction elements and/or a plurality of separate elements requiring precision fitting and/or relocation within the waveguides. Such configurations may add significant additional expense and/or operator skill requirements. Further, these complex solutions may provide unacceptable electrical performance and/or environmental seal degradation.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that the prior waveguide couplers incorporate an excessive number of discrete components and/or surface features with minimal parts harmonization between couplers with different coupling levels.

Figure 1:
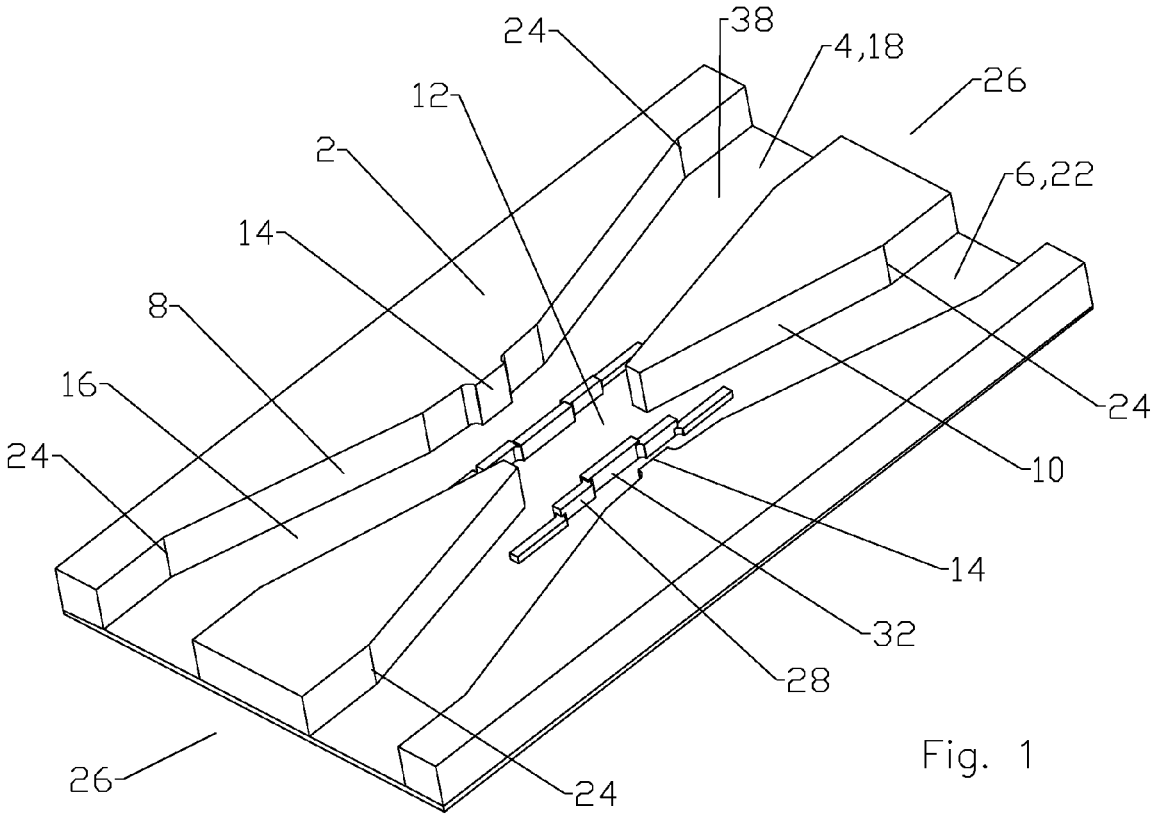
FIG. 1 is a schematic isometric view of an exemplary coupler embodiment, with the bottom removed for clarity.
Figure 2:
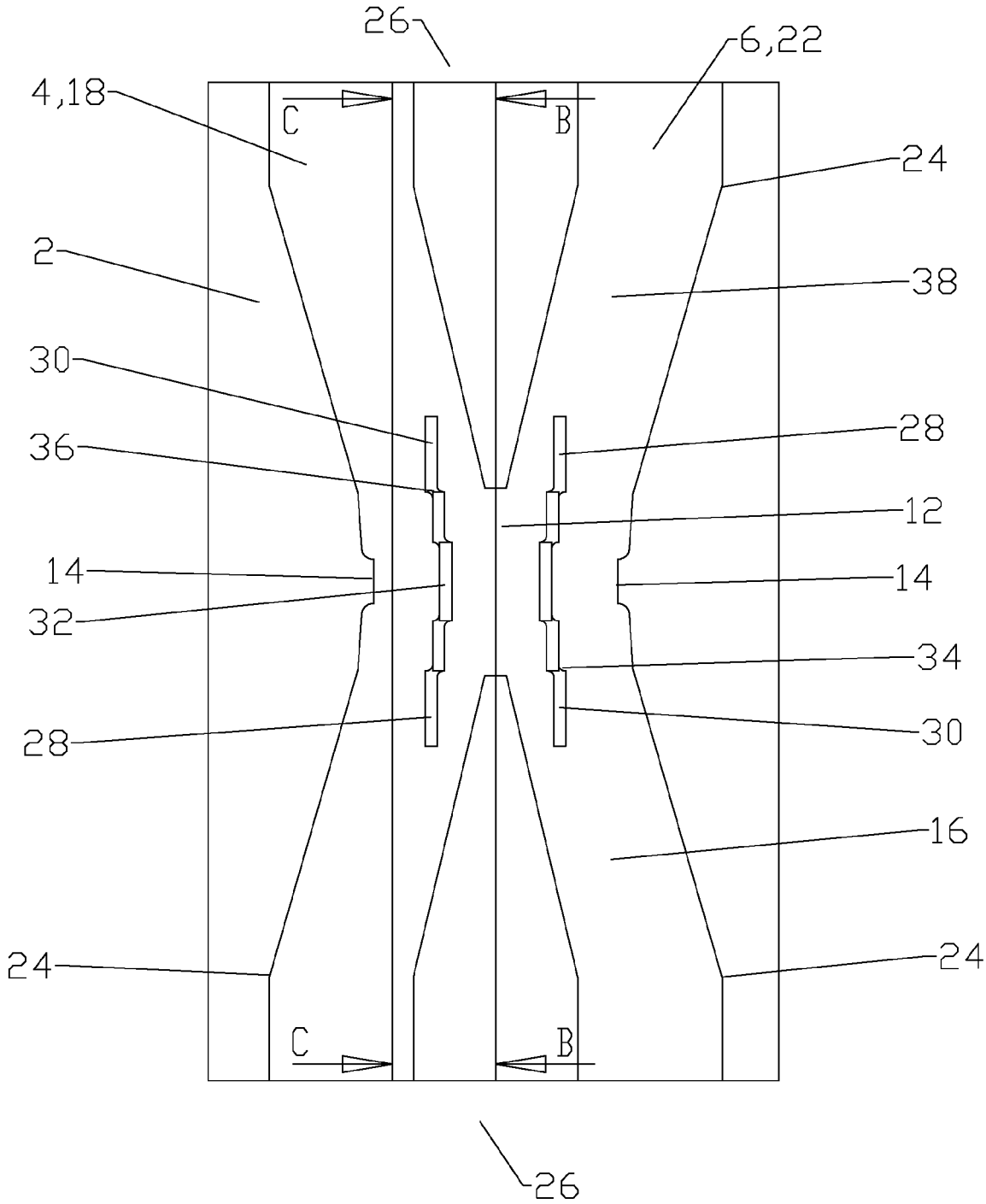
FIG. 2 is a schematic bottom view of the coupler of FIG. 1, with the bottom removed for clarity.
Figure 3:
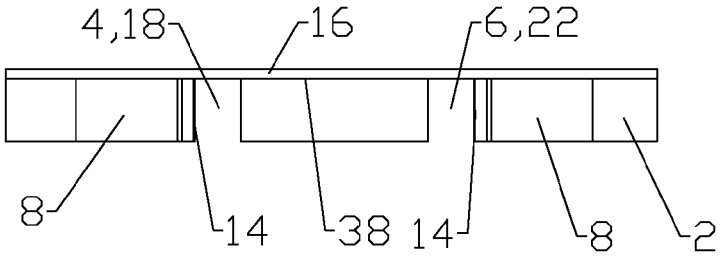
FIG. 3 is a schematic end view of the coupler of FIG. 1, bottom removed for clarity.
Figure 4:
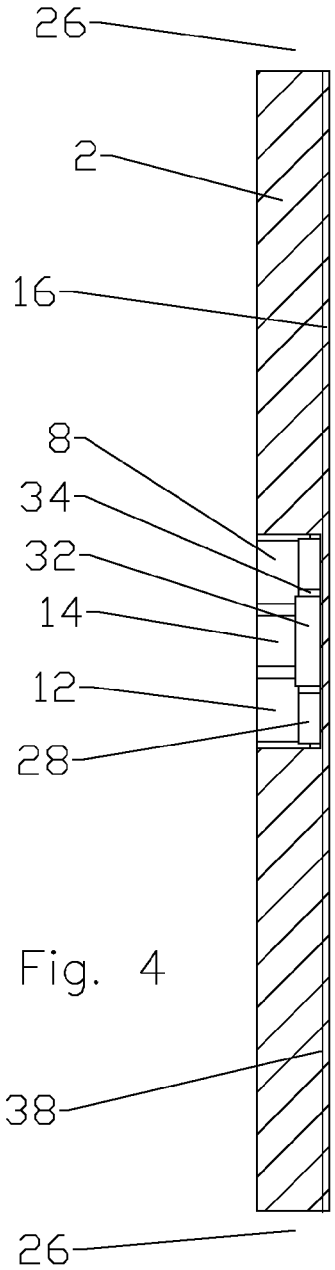
FIG. 4 is a schematic cross-section view taken along line B-B of FIG. 2.
Figure 5:
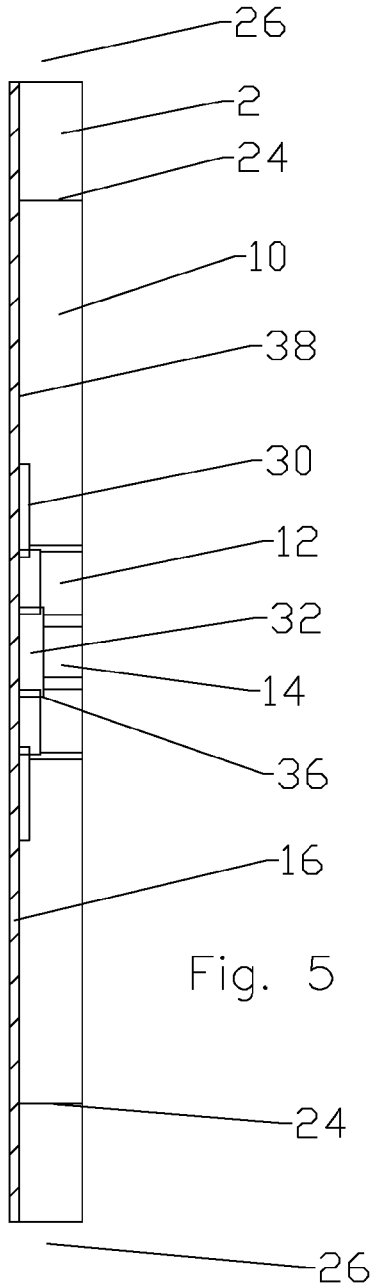
FIG. 5 is a schematic cross-section view taken along line C-C of FIG. 2.

An exemplary waveguide coupler, as shown in FIGS. 1-9, has a broad operating frequency band and may be configured for multiple coupling levels via the easy exchange of a single element. As best shown in FIG. 1, a trough portion 2 is provided with a first trough 4 and a second trough 6. The first trough 4 and the second trough 6 are each provided with a bottom (removed from FIGS. 1-5 for clarity), an outer sidewall 8 and an inner sidewall 10; the inner sidewall 10 of the first trough 4 and the inner sidewall 10 of the second trough 6 are adjacent one another.

A coupling slot 12 between the inner sidewall(s) 10 communicates between the first trough 4 and the second trough 6. The coupling slot 12 length may be selected according to, for example ½ guide wavelength and waveguide geometry. An inward projecting abutment 14 may be provided in each outer sidewall 8, opposite the coupling slot 12. The coupling slot 12 may be provided with a length along a longitudinal axis of the trough portion 2 that is greater than a width of the first trough 4. A cover 16 seats upon an open top 24 of the trough portion 2 to close the first trough 4 and the second trough 6, forming first and second waveguides 18, 22.

To enable simplified interconnection with adjacent waveguides the first trough 4 and the second trough 6 may be provided with a plurality of bend(s) 24 operative to locate the inner sidewall(s) 10 proximate the coupling slot 12 close to one another and to space the first and second waveguides 18, 22 parallel and apart at interconnection end(s) 26 so that suitable spacing is provided for ease of access to selected interconnection means, such as waveguide flanges or the like, for interconnection of the coupler with further waveguides. Particulars of various waveguide interconnection means are well known in the art and as such are not demonstrated or further described herein.

Figure 6:
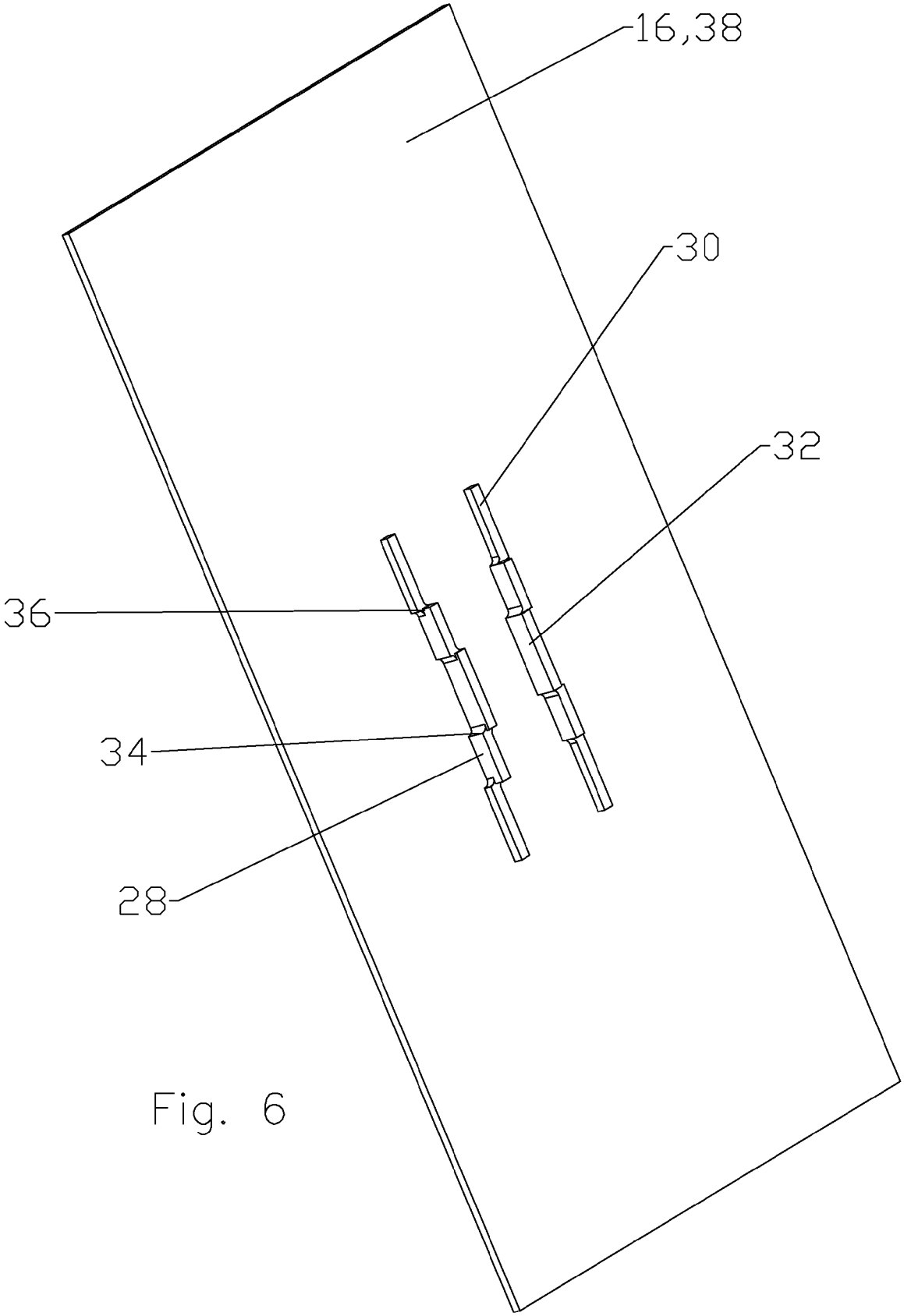
FIG. 6 is a schematic isometric bottom view of the cover of FIG. 1.
Figure 7:
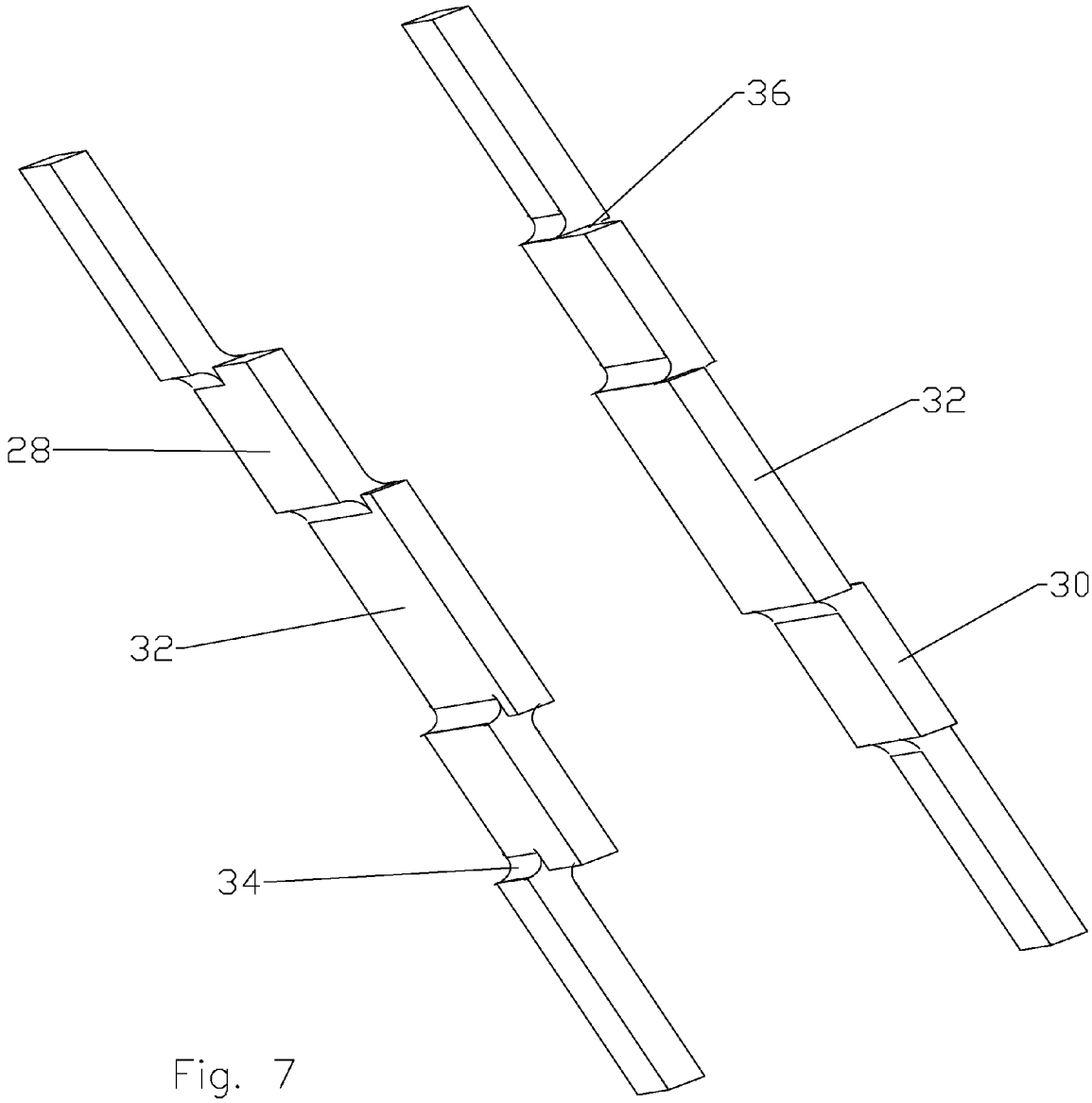
FIG. 7 is a close-up view of FIG. 6.
Figure 8:
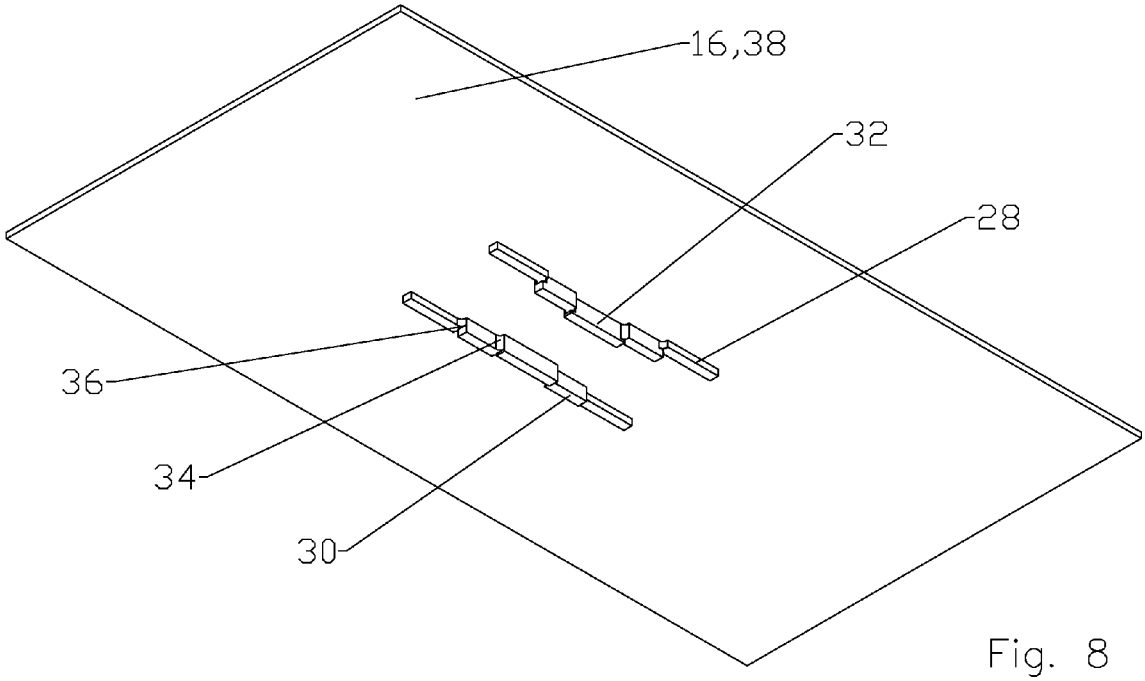
FIG. 8 is a schematic isometric view of an alternative cover.

As best shown in FIGS. 6-8, in a low coupling level configuration, for example 6 dB, the cover 16 may be provided with protrusion(s) 28 extending into the first trough 4 and the second trough 6. More particularly, as best shown in FIG. 7, the protrusion(s) 28 may be formed as a stepped ridge with a plurality of step(s) 30 in height. Further, the steps may also be provided with respect to lateral position. The step(s) 30 may be dimensioned symmetrically with respect to a center step 32 of the protrusion(s) 28, for example with a length and width corresponding to 0.25 and 0.05 wavelengths, respectively, of a desired operating frequency, the resulting protrusion(s) 28 binding RF energy as it passes, lowering the level of coupling across the coupling slot 12.

The step(s) 30 may be provided with a maximum inward extension from the cover 16 and a minimum lateral distance from the coupling slot 12 proximate a center of the coupling slot 12 selected with respect to desired RF performance, such as coupling, return loss and port to port isolation. A height differential between adjacent step(s) 30 may reduce with each step 30 toward the center step 32. A maximum inward extension of the step(s) 30 may be less than half of a height of the first trough 4. In the exemplary embodiment, two step(s) 30 are provided on each side of the center step 32.

For ease of manufacture, the steps in lateral position may be provided with a radius transition 34 between each step 30. Similarly, the steps in height may be provided with a right angle transition 36 between each step 30. Thereby, a machining operation during manufacture of the cover 16 may be performed cost effectively with high precision via standard cutting/grinding tool movements in only three axes.

Figure 9:
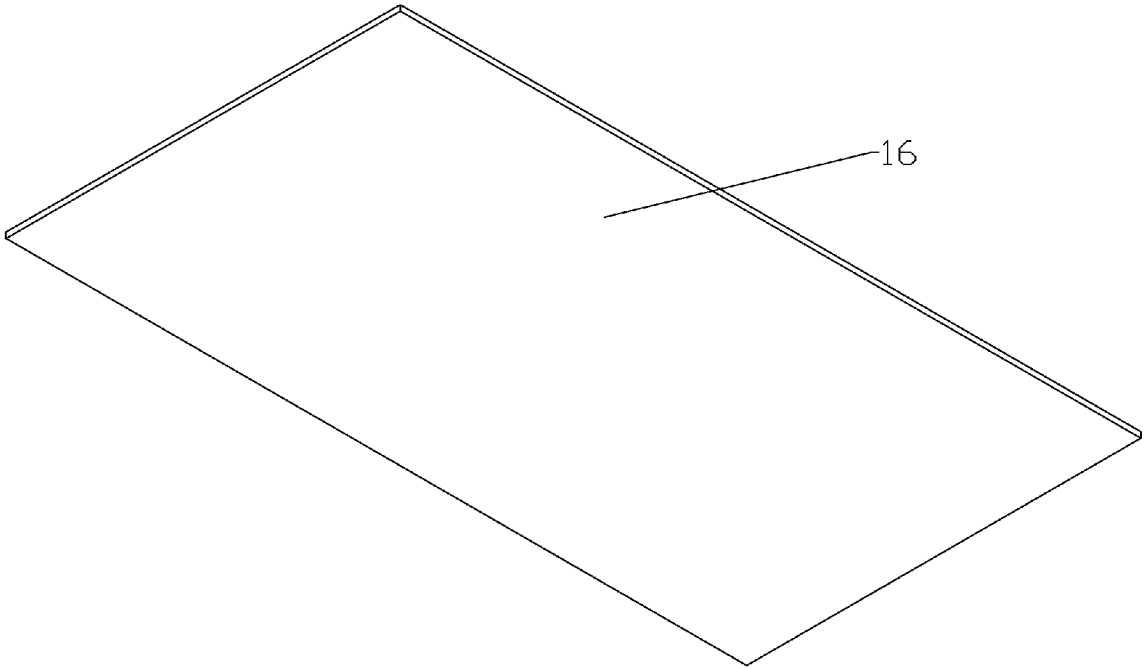
FIG. 9 is a schematic isometric view of another alternative cover.

In a high coupling level configuration, for example 3 dB, the cover 16 may be provided with a flat surface, for example as shown in FIG. 9. Thereby, the same trough portion 2 is operable at either a high or low coupling level via simple exchange of the cover 16. Alternatively, as shown in FIG. 8, the cover 16 attachment to the trough portion 2, for example via a plurality of fasteners or the like (not shown) may be configured to be swappable between a high coupling level flat surface, on a first side (not shown) and a low coupling level surface with the stepped inward projecting protrusions on a second side 38, eliminating the need for an additional separate part to obtain an easily selectable dual coupling level functionality.

Figure 10:
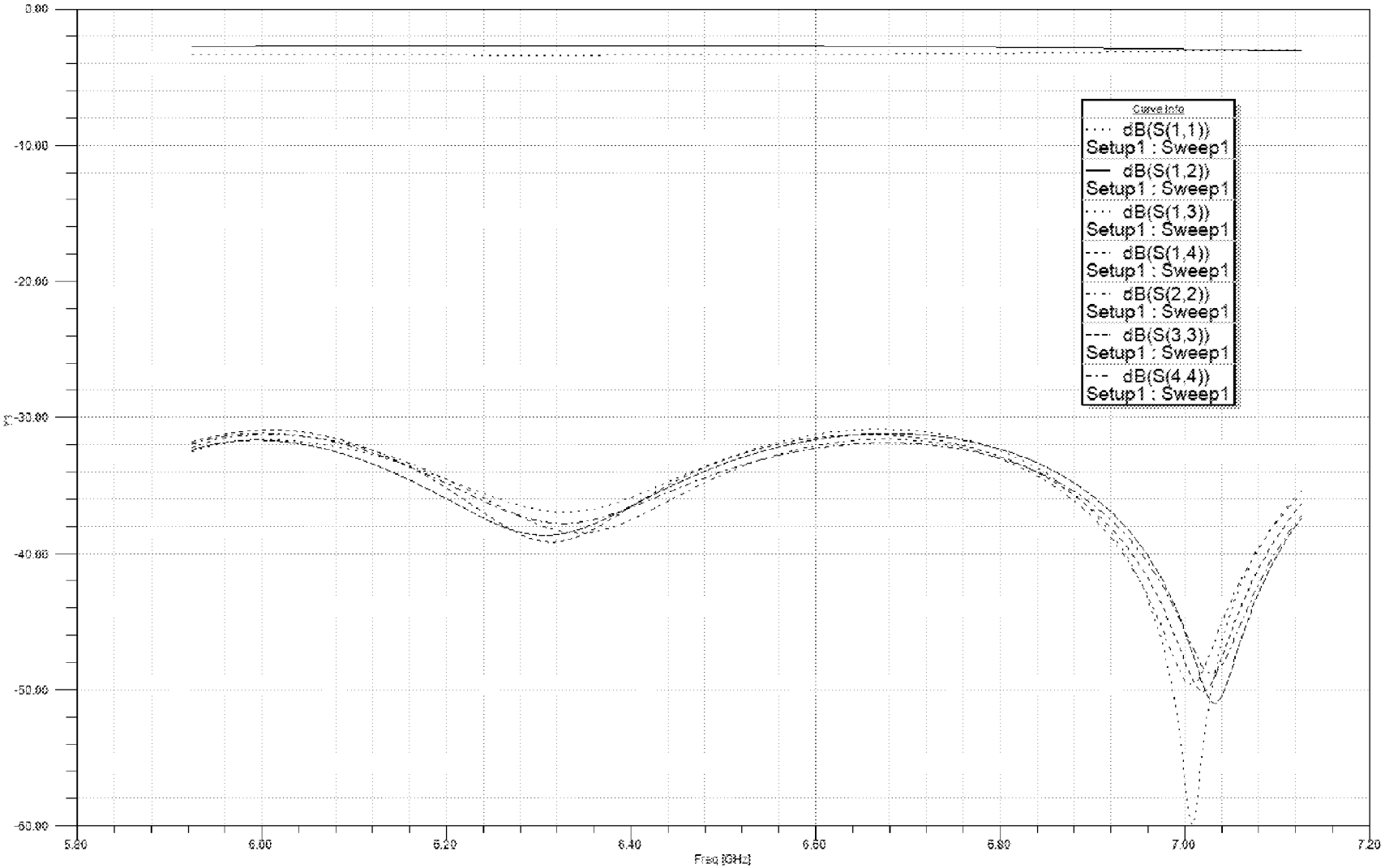
FIG. 10 is modeled electrical performance for the coupler of FIG. 1 in 3 dB configuration, showing coupling, return loss and port to port isolation between 5.925 and 7.125 Ghz.
Figure 11:
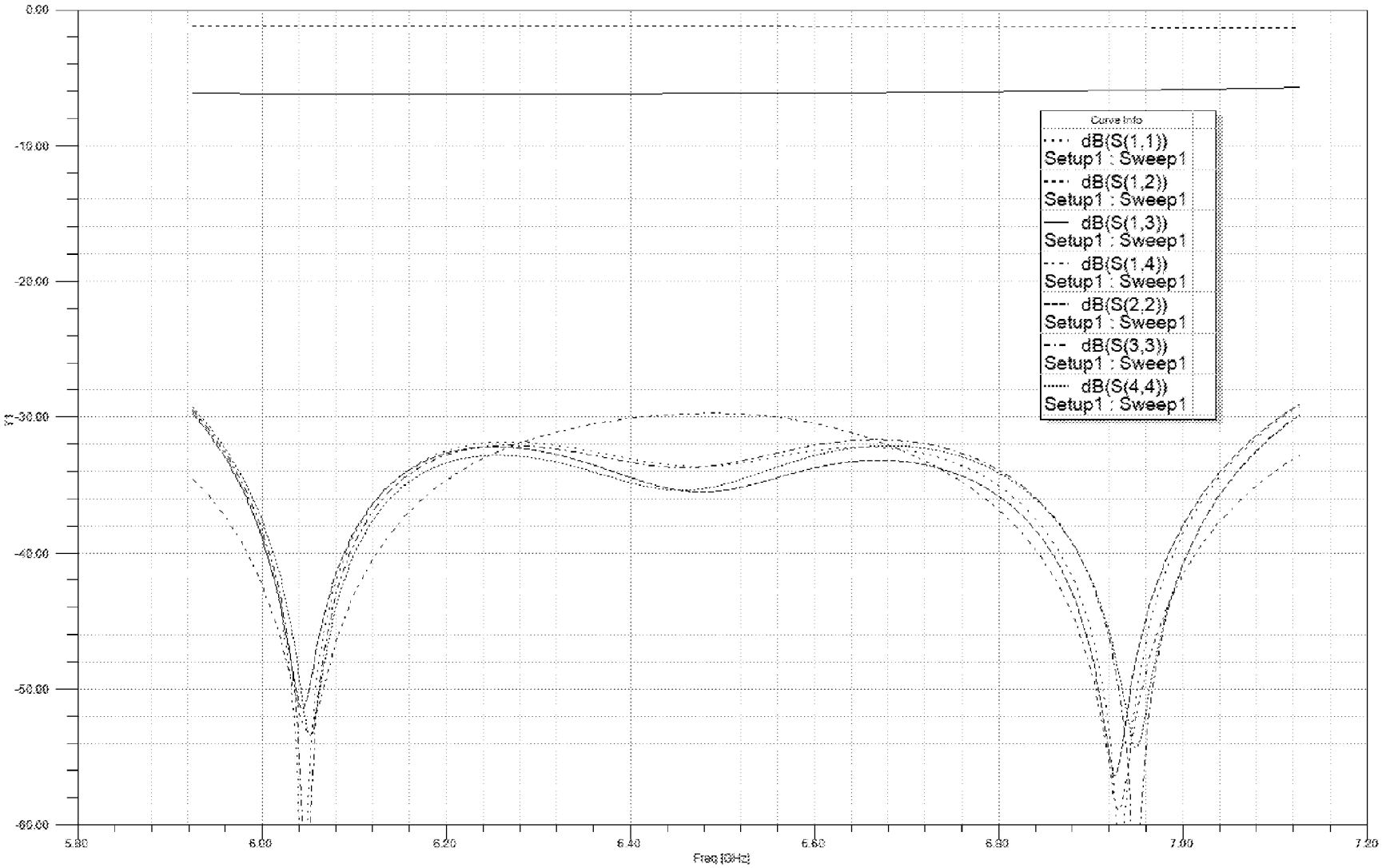
FIG. 11 is modeled electrical performance for the coupler of FIG. 1 in 6 dB configuration, showing coupling, return loss and port to port isolation between 5.925 and 7.125 Ghz.

Modeled electrical performance for the exemplary 3 dB (FIG. 10) and 6 dB (FIG. 11) coupler configurations demonstrates even coupling performance across a wide operating band, with high directivity.

One skilled in the art will appreciate that the trough portion 2 and the cover portion 16 may be cost effectively manufactured with high precision via three axis machining, die casting, metal injection molding and/or a combination of casting/molding followed by machining. Specific dimensions of the coupling slot 12, protrusion(s) 28 and abutment(s) 14 may be selected according to the desired waveguide dimensions, coupling level and operating frequency band. Because of the ability for the coupler to be configured as a 3 dB or 6 dB coupler, prior requirements for design, manufacture and stocking of multiple separate couplers have been eliminated. Further, configuration for use as either a 3 dB or 6 dB coupler may be quickly performed in the field with minimal chance of installation error.

Table of Parts

| | |
|---|---|
| 2 | trough portion |
| 4 | first trough |
| 6 | second trough |
| 8 | outer sidewall |
| 10 | inner sidewall |
| 12 | coupling slot |
| 14 | abutment |
| 16 | cover |
| 18 | first waveguide |
| 22 | second waveguide |
| 24 | bend |
| 26 | interconnection end |
| 28 | protrusion |
| 30 | step |
| 32 | center step |
| 34 | radius transition |
| 36 | right angle transition |
| 38 | second side |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A dual signal plane waveguide coupler, comprising: a trough portion with a first trough and a second trough; the first trough and the second trough each provided with a bottom, an outer sidewall and an inner sidewall; the inner sidewall of the first trough and the inner sidewall of the second trough adjacent one another; a coupling slot between the inner sidewalls communicates between the first trough and the second trough; an inward projecting abutment provided in each outer sidewall, opposite the coupling slot; a cover closes the first trough and the second trough to form first and second waveguides; the cover including protrusions extending into the first trough and the second trough; the protrusions forming a stepped ridge with a plurality of steps in height; the steps provided with a maximum inward extension and a minimum lateral distance from the coupling slot at a center step proximate a center of the coupling slot.

2. The coupler of claim 1, wherein the steps are symmetrical with respect to the center step.

3. The coupler of claim 1, wherein the steps in height are provided with a right angle transition between each step.

4. The coupler of claim 1, wherein a height differential between adjacent steps reduces with each step toward the center step.

5. The coupler of claim 1, wherein there are two steps on each side of the center step, along a longitudinal axis of the coupler.

6. The coupler of claim 1, wherein there is one step on each side of the center step, along a longitudinal axis of the coupler.

7. The coupler of claim 1, wherein the steps are provided with lateral displacement from one another.

8. The coupler of claim 7, wherein the steps in lateral position are provided with a radius transition between each step.

9. The coupler of claim 1, wherein the first waveguide and the second waveguide have a plurality of bends positioning the first waveguide and the second waveguide spaced apart and parallel to one another at an interconnecting end of the coupler.

10. The coupler of claim 1, wherein the protrusions are on a second side of the cover and a first side of the cover is flat; the cover attachable to the trough portion with either the first side or the second side facing the trough portion.

11. A coupling level configurable dual signal plane waveguide coupler, comprising: a trough portion with a first trough and a second trough; the first trough and the second trough each provided with a bottom, an outer sidewall and an inner sidewall; the inner sidewall of the first trough and the inner sidewall of the second trough adjacent one another; a coupling slot between the inner sidewalls communicates between the first trough and the second trough; an inward projecting abutment provided in each outer sidewall, opposite the coupling slot; a low coupling cover and a high coupling cover for closing the first trough and the second trough; the high coupling cover provided with a flat surface; the low coupling cover including protrusions extending into the first trough and the second trough; the protrusions forming a stepped ridge with a plurality of steps in height; the steps provided with a maximum inward extension and a minimum lateral distance from the coupling slot proximate a center of the coupling slot; whereby the high or the low coupling cover may be applied to close the first and second troughs to form a first waveguide and a second waveguide with a corresponding desired coupling level there between.

12. The coupler of claim 11, wherein the low coupling cover and the high coupling cover are respective first and second sides of a single element.

13. The coupler of claim 11, wherein the steps are symmetrical with respect to a center of the protrusions.

14. The coupler of claim 11, wherein there are two steps on each side of the center step, along a longitudinal axis of the coupler.

15. The coupler of claim 11, wherein the steps are provided with lateral displacement from one another.

16. The coupler of claim 11, wherein the steps in height are provided with a right angle transition between each step.

17. The coupler of claim 11, wherein a height differential between adjacent steps reduces with each step, toward a center step.

18. The coupler of claim 11, wherein a longitudinal length of the coupling slot is greater than a width of the first trough.

* * * * *